United States Patent [19]

Witten et al.

[11] Patent Number: 4,787,181

[45] Date of Patent: Nov. 29, 1988

[54] SHELTER AND SHELTER CONSTRUCTION METHOD

[75] Inventors: Donald W. Witten, Collinsville; Donald R. Downey, Tulsa, both of Okla.

[73] Assignee: Nordam, Tulsa, Okla.

[21] Appl. No.: 907,460

[22] Filed: Sep. 15, 1986

[51] Int. Cl.[4] ..... E04H 1/00

[52] U.S. Cl. ..... 52/79.1; 220/4 E

[58] Field of Search ..... 52/79, 67, 143, 577; 296/24 R, 29; 220/4 R, 4 E

[56] References Cited

U.S. PATENT DOCUMENTS

| | | | |
|---|---|---|---|
| 1,062,077 | 5/1913 | Burk | 52/577 X |
| 2,894,290 | 7/1959 | Lundstedt | 52/143 X |
| 3,295,279 | 1/1967 | Wilkins | 52/143 X |
| 3,382,625 | 5/1968 | Kuss | 52/79.1 X |
| 3,442,056 | 5/1969 | Van Derlely et al. | 52/79.7 |
| 3,463,526 | 8/1969 | Benicasa et al. . | |
| 3,496,689 | 2/1970 | Nerem | 52/204 |
| 3,517,468 | 6/1970 | Woods | 52/79.1 |
| 3,629,982 | 12/1971 | Ballay et al. | 52/79.5 X |
| 3,798,859 | 3/1974 | de Jong | 52/259 |
| 3,880,458 | 4/1975 | Jackson | 296/23 G |
| 3,909,995 | 10/1975 | Bainter | 52/79.1 |
| 3,968,989 | 7/1976 | Schippers | 296/29 |
| 4,115,656 | 9/1978 | Aitel | 52/79.8 X |
| 4,189,885 | 2/1980 | Fritz | 52/287 |
| 4,192,113 | 3/1980 | Martin | 52/282 |
| 4,271,975 | 6/1981 | Ketner et al. | 220/80 |
| 4,373,311 | 2/1983 | Artweger | 52/282 |
| 4,542,933 | 9/1985 | Bischoff | 296/164 |

FOREIGN PATENT DOCUMENTS

| | | | |
|---|---|---|---|
| 741049 | 8/1966 | Canada | 52/79.1 |
| 2607855 | 9/1977 | Fed. Rep. of Germany | 52/79.4 |
| 3023972 | 1/1982 | Fed. Rep. of Germany | 52/143 |
| 9560 | of 1905 | United Kingdom | 220/4 R |

*Primary Examiner*—Carl D. Friedman

*Attorney, Agent, or Firm*—Head & Johnson

[57] ABSTRACT

A shelter and method of constructing a shelter. The shelter comprises a unitary first shell and a unitary second shell. The first shell is formed by making at least two transverse bends in a single generally rectangular panel and provides a unitary top wall, bottom wall, and first end wall. The second shell is formed by making at least two transverse bends in a single, generally rectangular panel and provides a unitary second end wall, first side wall, and second side wall. The first and second shells are complementarily positioned to create the shelter. A first metallic member is bonded along the peripheral edge of the first shell and a second metallic member is bonded along the peripheral edge of the second shell means. The first and second metallic members adjoiningly facilitate welding the complementarily positioned first and second shells together. A sealable entryway is provided in at least one of the walls. Wheel wells may be provided for allowing the shelter to be transportably attached to a transport vehicle. The shelter construction will attenuate the passage of electromagnetic waves into the shelter.

22 Claims, 3 Drawing Sheets

SHELTER AND SHELTER CONSTRUCTION METHOD

BACKGROUND OF THE INVENTION

The present invention generally relates to shelters and shelter construction methods and more particularly is concerned with a shelter in which the entire body of the shelter may be formed from two complementarily positioned shells and which will shieldingly attenuate the passage of electromagnetic waves into the shelter.

SUMMARY OF THE INVENTION

It is an object of the present invention to provide a shelter and shelter construction method in which the entire body of the shelter can be quickly and easily formed from two shell means thereby reducing labor and material costs, which reduce the number of joints and therefore provide increased electromagnetic wave shielding and attenuation, and which incorporate aluminum extrusions around the peripheral edges of the shell means so that the joints may be welded together to provide electromagnetic wave attenuation without the heat of the welding procedure delaminating the bonding within the shell means.

Accordingly the present invention provides a shelter and method of constructing the shelter comprised of a unitary first shell means, a unitary second shell means, sealing means, and entryway means. The unitary first shell menas forms a unitary top wall, bottom wall, and first end wall. The unitary second shell means forms a unitary second end wall, first side wall, and second side wall. The first shell means and second shell means are complemntarily positioned to create the shelter. The sealing means sealingly engages the first and second shell means and may comprise a first metallic member bonded along the peripheral edge of the first shell means and a second metallic member bonded along the peripheral edge of the second shell means. The first and second metallic members facilitate the welding connection of the first shell means to the second shell means without delaminating the bonding in, or deforming, the first or second shell means and shieldingly attenuate the passage of electromagnetic waves into the shelter. The entryway means is located in at least one of the walls for sealably allowing entry into and exit from the shelter and many include means for shieldingly attenuating the passage of electromagnetic waves into the shelter. The shelter and method may also include wheel well means for allowing the shelter to transportably attached to a transport vehicle.

BRIEF DESCRIPTION OF THE DRAWINGS

The present invention will be better understood by reference to the examples of the following drawings.

DETAILED DESCRIPTION OF THE PREFERRED EMBODIMENTS

Before explaining the present invention in detail, it is to be understood that the invention is not limited to the details of construction and arrangement of parts illustrated in the accompanying drawings, since the invention is capable of other embodiments and of being practiced or carried out in various ways commensurate with the claims herein. Also it is to be understood that the phraseology or terminology employed herein is for the purpose of description and not of limitation.

Figure 1:
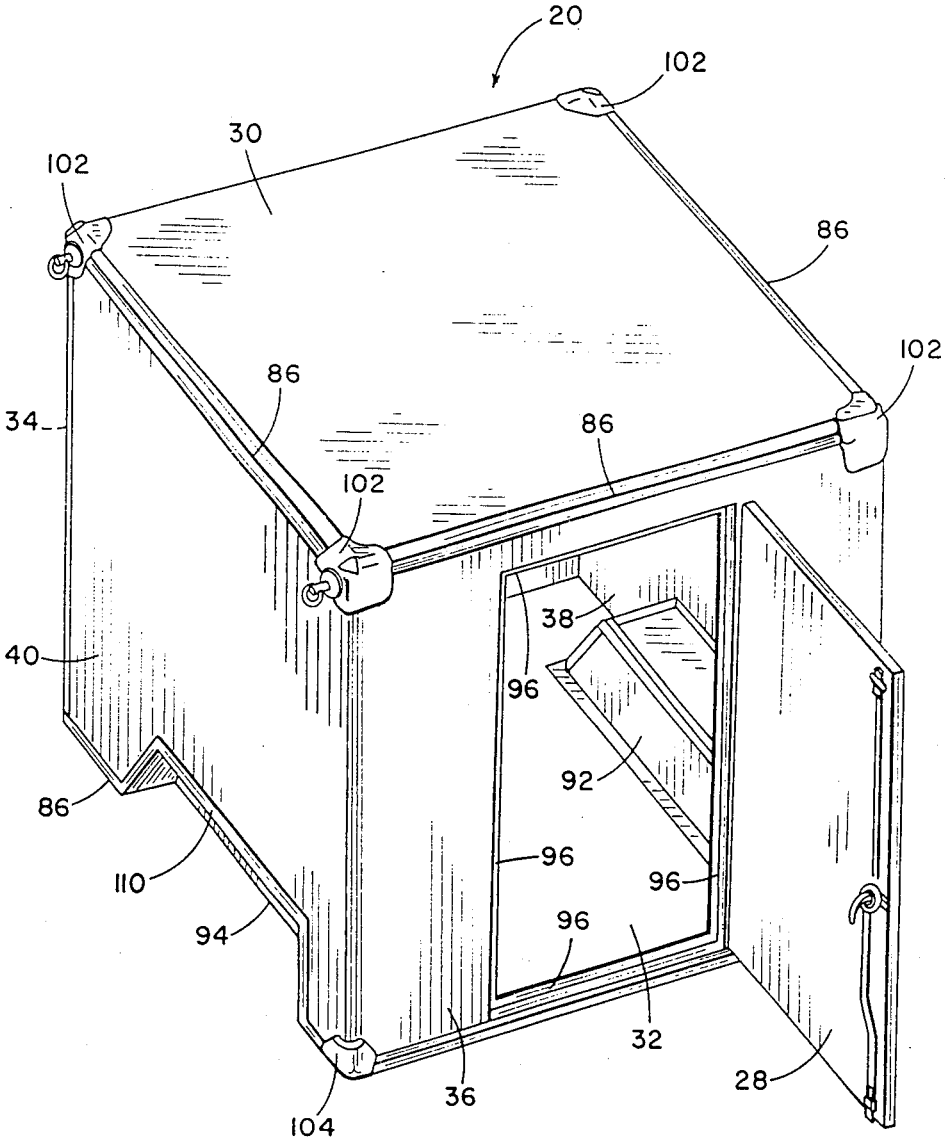
FIG. 1 is a perspective view of an embodiment of the present invention.

FIG. 1 presents one embodiment of the shelter, generally designated 20, of the present invention. The shelter 20 is basically comprised of a unitary first shell means 22, a unitary second shell means 24, sealing means 26, and entryway means 28, best seen in FIG. 2.

Figure 2:
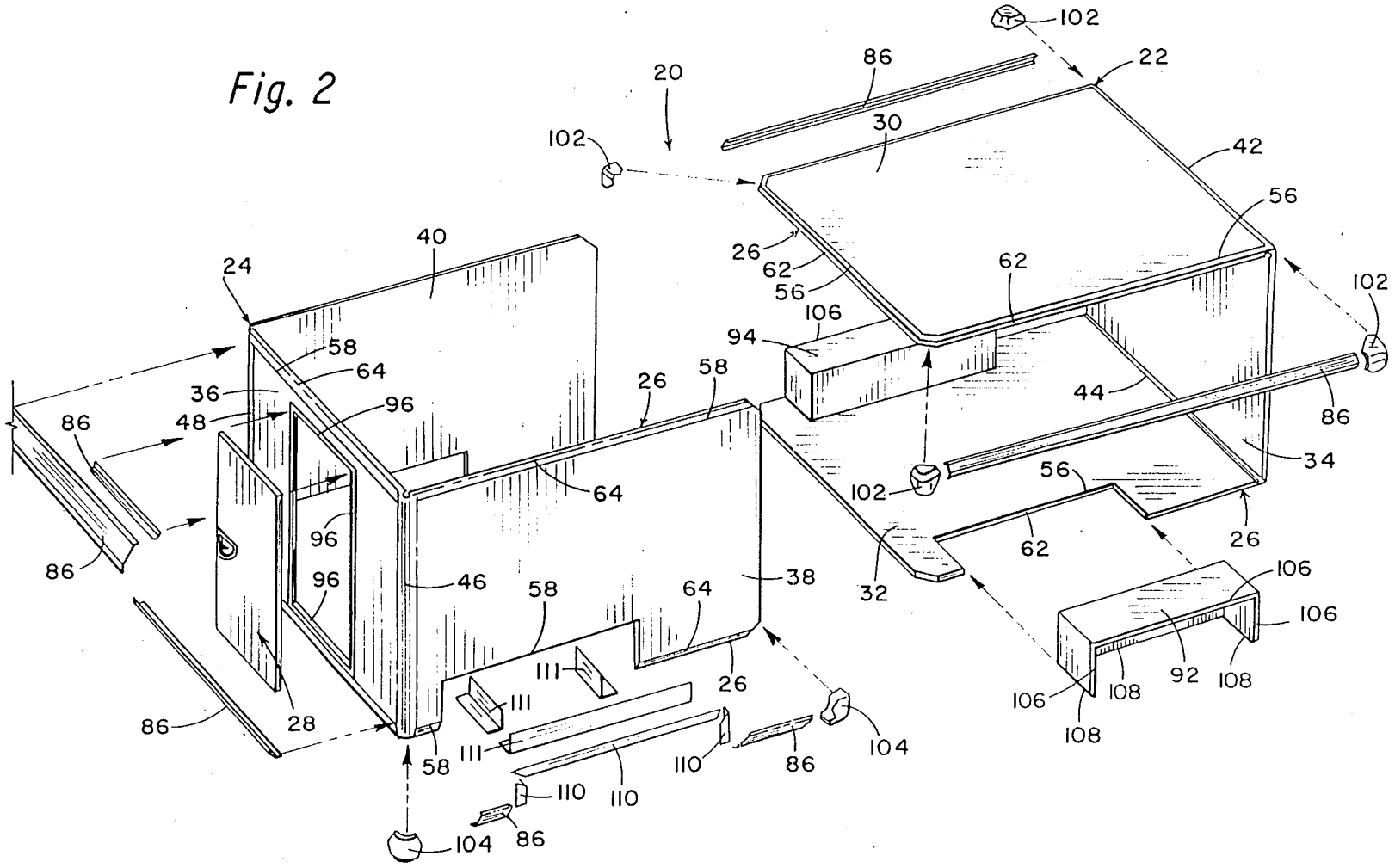
FIG. 2 is an exploded, perspective view of an embodiment of the present invention illustrating the assembly of the invention.

To give an overview of these basic elements, their function and interaction, referring to the example of FIG. 2, the unitary first shell means 22 is used for forming a unitary top wall 30, bottom wall 32, and first end wall 34. The unitary second shell means 24 is used for forming a unitary second end wall 36, first side wall 38, and second side wall 40. The first and second shell means 22, 24 are complementarily positioned to create the shelter 20, as seen in FIG. 2. The sealing means 26 is used for sealingly engaging the first and second shell means 22, 24, and may also comprise means for shieldingly attenuating the passage of electromagnetic waves into the shelter 20. The entryway means 28 is located in at least one of the walls 30, 32, 34, 36, 38, 40 and is used for sealably allowing entry into and exit from the shelter 20. The entryway means 28 may also include means for shieldingly attenuating the passage of electromagnetic waves into the shelter 20.

As exemplified in FIG. 2, the first shell means 22 may be formed from a single, formable, generally rectangular, and planar panel, also designated 22. The panel 22 should have at least two bends 42, 44. The bends 42, 44 should give the panel 22 the shape necessary to provide the top, bottom and first end walls 30, 32, 34 of the first shell means. Similarly, the second shell means 24 may be formed from a single, formable, generally rectangular, and planar panel 24. The panel 24 should have at least two bends 46, 48. The bends 46, 48 should give the panel 24 the shape necessary to provide the second end, first side, and second side walls 36, 38, 40 of the second shell means 24. The bends 42, 44, 46, 48 in the prototype are made transversely in the panels 22, 24, although other bending arrangements are possible, such as making longitudinal bends in one panel and transverse bends in the other.

Figure 3:
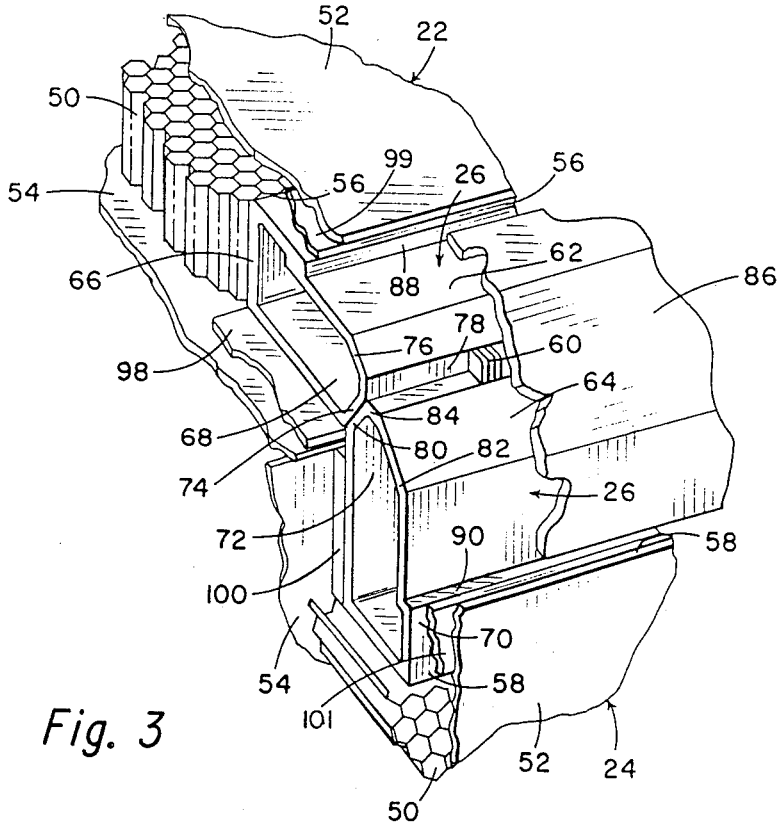
FIG. 3 is a fragmentary view of FIG. 1 illustrating the connection of a wall of the first shell means to a wall of the second shell means.
Figure 4:
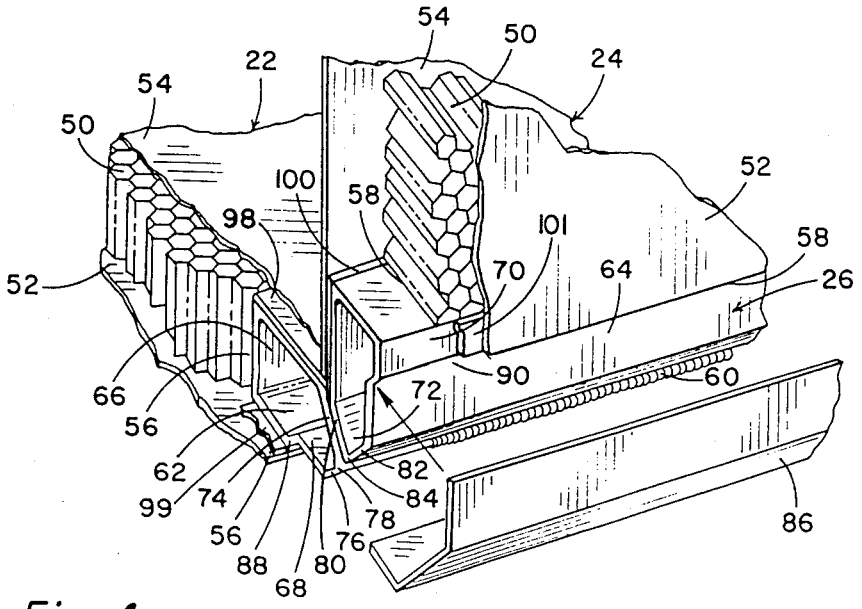
FIG. 4 is a fragmentary, partially exploded view of FIG. 1 illustrating the connection of a wall of the first shell means to a wall of the second shell means.

As exemplified in FIGS. 3 and 4, the first and second shell means or panels 22, 24 may each individually comprise a core 50 of filler material and at least two planar face plates 52, 54, with the core being bonded between the face plates 52, 54. Preferably the first and second shell means or panels 22, 24 will each individually comprise at least two metallic planar face plates also designated 52, 54 and a non-metallic honeycomb core 50 with the core 50 being adhesively bonded between the face plates 52, 54.

Referring to FIGS. 3 and 4, in the example embodiment, the sealing means 26 comprises welding means, also designated 26, attached along the peripheral edge of each of the first and second shell means 22, 24, i.e., there should be a welding mens 26 attached along the peripheral edge 56 of the first shell means 22 and a welding means 26 bonded along the peripheral edge 58 of the second shell means 24. The welding means 26 is used for facilitating the welding connection of the first shell means 22 to the second shell means 24 and for displacing the heat associated with making the weld away from the first and second shell means 22, 24. This allows the weld 60 to be made without deforming the first shell means 22, the second shell means 24, or the welding means 26; without delaminating the bonding within the first and second shell means 22, 24; and without delaminating the bonding between the welding means 26 and the first and second shell means 22, 24.

The present invention also includes the method of constructing the shelter 20 described supra. Referring to FIG. 2, the method basically comprises the steps of:

making at least two bends 42, 44 in a unitary and formable first shell means 22 in order to form a unitary top wall 30, bottom wall 32, and first end wall 34;

making at least two bends 46, 48 in a unitary and formable second shell means 24 in order to form a unitary second end wall 36, first side wall 38, and second side wall 40;

complementarily positioning the first and second shell means 22, 24 to create the shelter 20;

sealingly engaging the first and second shell means 22, 24; and sealably allowing entry into and exit from the shelter 20 through at least one of the walls 30, 32, 34, 36, 38, 40.

Referring to FIGS. 3 and 4, in the method, as with the shelter 20, t he first and second shell means 22, 24 may each comprise at least two planar face plates 52, 54 and a core 50 of filler material, the core being bonded between the face plates 52, 54. Preferably, the first and second shell means 22, 24 should each comprise at least two metallic planar face plates 52, 54 and a nonmetallic honeycomb core 50, the core being adhesively bonded between the face plates.

The sealing step of the method, described supra, may further comprise the steps of:

bonding a welding means 26 to the peripheral edge 56, 58 of each of the first and second shell means 22, 24; and welding the welding means 26 of the first shell means 22 to the welding means 26 of the second shell means 24 without deforming the first shell means 22, the second shell means 24, or the welding means 26; without delaminating the bonding between the welding means 26 and the first and second shell means 22, 24; and without delaminating the adhesive bonding within the first and second shell means 22, 24.

The method may further comprise the step of shieldingly attenuating the passage of electromagnetic waves into the shelter 20. This shielding step is normally effected by the type of sealing implemented in the steps of sealingly engaging the first and second shell means 22, 24 and in the sealable entry step. The details of implementing these steps are discussed, infra, as is the construction of the first and second shell means 22, 24 which is necessary to complete the shielding.

In both the shelter 20 and method of constructing the shelter, as exemplified in FIGS. 3 and 4, the welding means 26 may comprise a first metallic member 62 and a second metallic member 64. In cross section the first member 62 has a bottom end 66 bonded along the peripheral edge 56 of the first shell means 22 and has a top end 68. The second member 64 has a bottom end 70 bonded along the peripheral edge 58 of the second shell means 24 and has a top end 72. The top end 68 of the first member 62 should weld receivingly adjoin the top end 72 of the second member 64 when the first and second shell means 22, 24 are complementarily positioned to form the shelter 20.

Referring to FIGS. 3 and 4, in the prototype shelter 20 and method the first and second members 62, 64 are extruded, hollow, metallic members, preferably made from aluminum, aluminum alloy, or equivalent. The transversely cross-sectional bottom end 66 of the first member 62 is generally rectangular shaped and is adhesively bonded along the peripheral edge 56 of the first shell means 22. The transversely cross-sectional bottom end 70 of the second member 64 is generally rectangularly shaped and is adhesively bonded along the peripheral edge 58 of the second shell means 24. The transversely cross-sectional top end 68 of the first member 62 is generally triangularly shaped and has a triangular side 74 generally facing the inside of the shelter 20 and a triangular side 76 generally facing the outside of the shelter 20. The apex 78 of the triangular top end 68 is slightly flattened to receive the weld 60.

The transversely cross-sectional top end 72 of the second member 64 is generally triangularly shaped and has a triangular side 80 generally facing the inside of the shelter and a triangular side 82 generally facing the outside of the shelter 20. The apex 84 of the triangular top end 72 is slightly flattened to receive the weld 60.

When the first and second shell means 22, 24 are complementarily positioned to form the shelter 20, the inside facing triangular side 74 of the first member 62 should complementarily adjoin the inside facing triangular side 80 of the second member 64, i.e., the adjoined inside facing triangular sides 74, 80 should allow the walls of the first and second shell means 22, 24 to which the adjoined inside facing triangular sides 74, 80 are bonded to be disposed in perpendicular relationship. In other words, the adjoined inside triangular sides 74, 80 should facilitate an angular relationship of ninety degrees between adjoining walls. The outside facing triangular sides 76, 82 of the first and second members 62, 64 should form a surface generally perpendicular to the plane of the adjoining inside facing triangular sides 74, 80 and the flattened apexes 78, 84 of the top ends 68, 72 should adjoin to form a weld receiving crevice, as exemplified in FIGS. 3 and 4.

It is recognized that the first and second metallic members 62, 64 may be of any shape which will allow the first and second shell means 22, 24 to be welded together and that the adjacent walls of the shelter may have angular relationships other than ninety degrees. Also the first and second shell 22, 24 means may be fastened together by other methods than welding, with or without utilizing the welding means 26, such as adhesive bonding, mechanical fastening, etc., although welding is the most efficient method known to the inventor which also shieldingly attenuates the passage of electromagnetic waves through the fastening method into the shelter 20.

The prototype shelter 20 and method, referring to FIGS. 3 and 4, also comprises cap means 86, attached to the outside surface of the adjoined first and second metallic members 62, 64 for covering the first and second metallic members 62, 64. As illustrated, the cap means 86 may conform to the shape of the outside surface of the adjoined first and second metallic members 62, 64. The cap means 86 of the prototype are mechanically fastened with rivets to the first and second metallic members 62, 64 although other forms of fastening, such as adhesive bonding, welding, bolts, screws, etc. may be used. In the prototype the cap means 86 are extruded from the same material as the first and second metallic members 62, 64. The cap means 86 also add structural integrity to the shelter 20.

Also, in the prototype, the outside surface of the bottom end 66, 70 of each of the first and second metallic members 62, 64 has a recess 88, 90 for receiving the cap means 86. The recesses 88, 90 should be of sufficient depth to maintain the outside surface of the cap means 86 generally flush with the outside face plates 52 of the first and second shell means 22, 24.

The prototype shelter 20 and method, illustrated in FIG. 2, comprises wheel well means 92, 94, located near the opposite first and second side walls 38, 40 of the shelter 20, for receiving the wheels of a transport vehicle and for allowing the shelter 20 to be transportably attached to a transport vehicle. The wheel well means 92, 94 may comprise means for shieldingly attenuating the passage of electromagnetic waves into the shelter 20.

As examplified in FIG. 1, the prototype of the shelter and method 20 was designed to meet the current requirements of military MIL-S-5541 specification for shelter model no. S-250 and was designed for use on a truck such as a pickup. More specifically, the prototype shelter 20 was designed to be mounted on the U.S. Army's latest 1¼ ton, four wheel drive vehicle.

The entryway means 28 of the military prototype is located in the second end wall 36 of the second shell means 24, as the second end wall 24 allows the easiest access from outside a typical pickup. The entryway means 28 may be located in any wall 30, 32, 34, 36, 38, 40 of the shelter 20 to satisfy a particular need or desire. The entryway means 28 of the military prototype includes a door 28 which is inset into the second end wall 36 when the door is closed. The door jamb 96 extends around all four sides of the doorway to provide a good seal and to attenuate the passage of electromagnetic waves into the shelter 20.

In the military prototype of the shelter 20 and method, the planar face paltes 52, 54 are made of 0.040 inch thick aluminum sheets and the core 50 is a non-metallic phenolic coated paper honeycomb, best seen in FIGS. 3 and 4. The face plates 52, 54 of the prototype extend beyond the core 50 along the peripheral edges 56, 58 of the first and second shell means 22, 24 to create a channel in which the bottom ends 66, 70 of the first and second metallic members 62, 64 are adhesively and integrally bonded, as best seen in FIGS. 3 and 4. Thus, in the prototype, the first and second metallic members are an integral part of the first and second shell means 22, 24. Thermal barriers 98, 99, 100, 101 are provided in the channel to provide a thermal break and also are utilized as electrical continuity barriers in order to provide two separate electrical ground planes utilizing face plates 52 and 54. In the prototype the thermal barriers 98, 99, 100, 101 are made of plastic laminate.

In the military prototype of the shelter 20 and method, there are two transverse bends in each of the first and second shell means 22, 24. The transverse bends 42, 44, 46, 48 are made by crimping the planar panels 22, 24 on the side which is to be the inside of the shelter 20. The sealing means 26 or first and second metallic members 62, 64 extend completely around the peripheral edges 56, 58 except at the transverse bends 42, 44, 46 and 48 because of the size reductions and structural distortions created by the crimping and bending. The phenolic coated paper honeycomb core 50 is fiber reinforced in the area of the transverse ends 42, 44, 46, 48 in the prototype. The fiber reinforcement given the honeycomb core 50 the resilience necessary to prevent shattering of the core in the transverse bends 42, 44, 46, 48.

The corners of the shelter created by the transverse bends 42, 44, 46, 48 are sealed with upper corner caps 102 and lower corner caps 104. Although not all of the corner caps 102, 104 are visible in the drawings, there are a total of eight corner caps on the prototype shelter 20, one corner cap on each corner. The upper corner caps 102 may include lifting eyes, as exemplified in FIG. 1, to allow mechanically lifting the shelter 20 on and off a truck and a means of securing the shelter to the vehicle. The corner caps 102, 104 protect and strengthen the corners of the shelter 20 and provide shielding at the corners to attenuate the passage of electromagnetic waves into the shelter 20. The corner caps 102, 104 may be mechanically fastened with rivets, bolts, screws, etc. to the shelter 20; and in the prototype they are riveted to the shelter. The prototype corner caps 102, 104 are made of aluminium alloys.

As previously stated, the planar panels 22, 24 from which the prototype first and second shelter means 22, 24 are made are of aluminum sheet and phenolic coated paper honeycomb construction, which provides electromagnetic wave shielding. The welding means 26 or first and second metallic members 62, 64 of the prototype shelter 20, are designed to allow the first and second shelter means 22, 24 to be welded together in order to provide good electromagnetic wave attenuation along the adjoining edges of the first and second shelter means 22, 24.

In the military prototype the peripheral edges 106, 108 of the wheel well means 92, 94 are of similar construction to the peripheral edges 56, 58 of the first and second shell means 22, 24 discussd supra. Metallic members (not illustrated) substantially identical to the first and second members 62, 64 are intetrally bonded to the contacting peripheral edges 106 of wheel well means 92, 94 and the first shell means 22. This engagement between the wheel well means 92, 94 and the first shell means 22 is then welded and covered with cap means 110, substantially identically to the engagement of the first and second shell means 22, 24. For expediency in manufacture and assembly of the shelter 20, metallic members (not illustrated) which are rectangular in transverse cross-section are integrally bonded to the contacting peripheral edges 108 of the wheel well means 92, 94 and the second shell means 24. These rectangular metallic members fit together to form a ninety-degree corner and are covered with an extruded cap means 111 which is extruded in a shape to fit the ninety-degree corner. The rectangular metallic members are not welded together, but the ninety-degree cap means 111 is mechanically fastened to the rectangular metallic members and this mechanical fastening engages the wheel well means 92, 94 to the second shell means 24 in the prototype. The cap means 110, 111 are mechanically fastened to he metallic members with rivets, although bolts, screws and other types of fastening will work.

While the invention has been described with a certain degree of particularity it is manifest that many changes may be made in the details of construction and the arrangement of components without departing from the spirit and scope of this disclosure. it is understood that the invention is not limited to the embodiments set forth herein for purposes of exemplification, but is to be limited only by the scope of the attached claim or claims including the full range of equivalency to which each element thereof is entitled.

What is claimed is:

1. A shelter, comprising:

a unitary first shell means for forming a unitary top wall, bottom wall, and first end wall;

a unitary second shell means for forming a unitary second end wall, first side wall, and second side wall, the first and second shell means being complementarily positioned to create the shelter;

entryway means, located in at least one of the walls, for sealably allowing entry into and exit from the shelter;

a first metallic member, in transverse cross-section the first metallic member having a bottom end bonded along the peripheral edge of the first shell means and having a top end;

a second metallic member, in transverse cross-section the second metallic member having a bottom end bonded along the peripheral edge of the second shell means and having a top end; and wherein the top end of the first metallic member weld receivingly adjoins the top end of the second metallic member when the first and second shell means are complementarily positioned to form the shelter.

2. The shelter of claim 1:

wherein the first shell means is formed from a single, formable, generally rectangular and planar panel, the panel having at least two bends; and wherein the second shell means is formed from a single, formable, generally rectangular and planar panel, the panel having at least two bends.

3. The shelter of claim 1 in which the first and second shell means each comprise:

at least two planar face plates; and a core of filler material, the core being bonded between the face plates.

4. The shelter of claim 1 in which the first and second shell means each comprise:

at least two metallic planar face plates; and a non-metallic honeycomb core, the core being adhesively bonded between the face plates.

5. The shelter of claim 1 wherein the first and second metallic members are extruded hollow metallic members; and wherein the bottom end of each of the first and second metallic members is generally rectangularly shaped; and wherein the top end of each of the first and second metallic members is generally triangularly shaped, one triangular side generally facing the inside and the other triangular side generally facing the ouside of the shelter, the apex of the triangular top end of the first and second metallic members being slightly flattened; and wherein the inside facing triangular side of the first metallic member complementarily adjoins the inside facing triangular side of the second metallic member with the outside facing triangular sides of the first and second metallic members forming a surface generally perpendicular to the adjoining inside facing triangular sides and the flattened apexes of the top ends adjoining to form a weld receiving crevice when the first and second shell means are positioned to form a shelter.

6. The shelter of claim 5 comprising:

cap means, attached to the outside surface of the adjoined first and second metallic members, for covering the first and second metallic members.

7. The shelter of claim 6 wherein the outside surface of the bottom end of each of the first and second metallic members has a recess for receiving the cap means.

8. The shelter of claim 1 further comprising;

wheel well means, located near the first and second side walls of the shelter, for allowing the shelter to be transportably attached to a transport vehicle.

9. The wheel well means of claim 8, further comprising:

means for shieldingly attenuating the passage of electromagnetic waves into the shelter.

10. A shelter, comprising:

a unitary first shell means for forming a unitary top wall, bottom wall, and first end wall;

a unitary second shell means for forming a unitary second end wall, first side wall, and second side wall, the first and second shell means being complementarily positioned to create the shelter, the first and second shell means including:

at least two metallic planar face plates; and a non-metallic honeycomb core, the core being adhesively bonded between the face plates;

sealing means for sealingly engaging the first and second shell means, the sealingly means including welding means for facilitating the welding connection of the first shell means to the second shell means and for displacing the heat associated with making the weld away from the first and second shell means thereby allowing the weld to be made without deforming the first shell means, the second shell means, or the welding means; without delaminating the bonding within the first and second shell means; and without delaminating the bonding between the welding means and the first and second shell means; the welding means including:

a first metallic member, in transverse cross-section the first metallic member having a bottom end bonded along the peripheral edge of the first shell means and having a top end;

a second metallic member, in transverse cross-section the second metallic member having a bottom end bonded along the peripheral edge of the second shell means and having a top end; and wherein the top end of the first metallic member weld receivingly adjoins the top end of the second metallic member when the first and second shell means are complementarily positioned to form the shelter; and entryway means, located in at least one of the walls, for sealably allowing entry into and exit from the shelter.

11. The shelter of claim 10:

wherein the first and second metallic members are extruded hollow metallic members; and wherein the bottom end of each of the first and second metallic members is generally rectangularly shaped; and wherein the top end of each of the first and second metallic members is generally triangularly shaped, one triangular side generally facing the inside and the other triangular side generally facing the outside of the shelter, the apex of the triangular top end of the first and second metallic members being slightly flattened; and wherein the inside facing triangular side of the first metallic member complementarily adjoins the inside facing triangular side of the second metallic member with the outside facing triangular sides of the first and second metallic members forming a surface generally perpendicular to the adjoining inside facing triangular sides and the flattened apexes of the top ends adjoining to form a weld receiving crevice when the first and second shell means are positioned to form a shelter.

12. The shelter of claim 11, comprising:

cap means, attached to the outside surface of the adjoined first and second metallic members, for covering the first and second metallic members.

13. The shelter of claim 12:

wherein the outside surface of the bottom end of each of the first and second metallic members has a recess for receiving the cap means.

14. A shelter, comprising:

a unitary first shell means for forming a unitary top wall, bottom wall, and first end wall;

a unitary second shell means for forming a unitary second end wall, first side wall, and second side wall, the first and second shell means being complementarily positioned to create the shelter;

entryway means, located in at least one of the walls, for sealably allowing entry into and exit from the shelter;

a first metallic member, in transverse cross-section the first metallic member having a bottom end bonded along the peripheral edge of the first shell means and having a top end;

a second metallic member, in transverse cross-section the second metallic member having a bottom end bonded along the peripheral edge of the second shell means and having a top end; and wherein the top end of the first metallic member weld receivingly adjoins the top end of the second metallic member when the first and second shell means are complementarily positioned to form the shelter.

15. The shelter of claim 14:

wherein the top end of the first metallic member and the top end of the second metallic member are in continuous weld receiving adjoinment along the complementary adjoinment of the first and second shell means.

16. The shelter of claim 14:

wherein the top end of the first metallic member and the top end of the second metallic member are continously welded along the complementary adjoinment of the first and second shell means.

17. A shelter, comprising:

a unitary first shell means for forming a unitary top wall, bottom wall, and first end wall;

a unitary second shell means for forming a unitary second end wall, first side wall, and second side wall, the first and second shell means being complementarily positioned to create the shelter, the first and second shell means including:

at least two metallic planar face plates; and a non-metallic honeycomb core, the core being adhesively bonded between the face plates;

entryway means, located in at least one of the walls, for sealably allowing entry into and exit from the shelter;

a first metallic member, in transverse cross-section the first metallic member having a bottom end bonded along the peripheral edge of the first shell means and having a top end;

a second metallic member, in transverse cross-section the second metallic member having a bottom end bonded along the peripheral edge of the second shell means and having a top end; and wherein the top end of the first metallic member weld receivingly adjoins the top end of the second metallic member when the first and second shell means are complementarily positioned to form the shelter.

18. The shelter of claim 17:

wherein the metallic planar face plates of the first shell means are further defined as being an outside face plate generally facing the outside of the shelter and an inside face plate generally facing the inside of the shelter; and wherein the metallic planar face plates of the second shell means are further defined as being an outside face plate generally facing the outside of the shelter and an inside face plate generally facing the inside of the shelter; the shelter further comprising:

a first conductivity barrier placed between the first shell means outside face plate and the first metallic member for electrically and thermally isolating the first shell means outside face plate and the first metallic member;

a second conductivity barrier placed between the first shell means inside face plate and the first metallic member for electrically and thermally isolating the first shell means inside face plate and the first metallic member, the first conductivity barrier and the second conductivity barrier thereby cooperating to electrically and thermally isolate the first sheell means outside face plate from the first shell means inside face plate;

a third conductivity barrier placed between the second shell means outside face plate and the second metallic member for electrically and thermally isolating the second shell means outside face plate and the second metallic member; and a fourth conductivity barrier placed between the second shell means inside face plate and the second metallic member for electrically and thermally isolating the second shell means inside face plate and the second metallic member, the third conductivity barrier and the fourth conductivity barrier thereby cooperating to electrically and thermally isolate the second shell means outside face plate and the second shell means inside face plate.

19. The shelter of claim 18 wherein the first shell means inside face plate and the second shell means inside face plate are connected in electrical continuity.

20. A method of constructing a shelter, comprising the steps of:

making at least two bends in a unitary and formable first wall means in order to form a unitary top wall, bottom wall and first end wall;

affixing the bottom end of a first metallic member to the peripheral edge of the bent first wall member, the first metallic member having a top end;

making at least two bends in a unitary and formable second wall means in order to form a unitary second end wall, first sidewall and second side wall;

affixing the bottom end of a second metallic member to the peripheral edge of the bent second wall member, the second metallic member having a top end;

complementarily positioning the first and second bent wall members whereby the top ends of the first and second metallic members abut along their full lengths;

welding the abutted metallic members along their full lengths; and forming a closeable entry passageway through one of the walls.

21. The method of claim 20 in which the first and second shell means each comprise:

at least two planar face plates; and a core of filler material, the core being bonded between the face plates.

22. The method of claim 20, further comprising the step of:

receiving the wheels of a transport vehicle with the shelter in order to transportably attach the shelter to a transport vehicle.

* * * * *